US006620088B2

(12) United States Patent
Jeschke et al.

(10) Patent No.: US 6,620,088 B2
(45) Date of Patent: Sep. 16, 2003

(54) SPLITTER MODULE FOR FOLDING SYSTEM ON PRINTING MACHINES

(75) Inventors: Andreas Jeschke, Grossfriesen (DE); Frank Schmieder, Plauen (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 10/001,117

(22) Filed: Nov. 27, 2001

(65) Prior Publication Data

US 2002/0065182 A1 May 30, 2002

(30) Foreign Application Priority Data

Nov. 29, 2000 (DE) ..... 100 59 191

(51) Int. Cl.[7] ..... B65H 45/16

(52) U.S. Cl. ..... 493/426; 493/398; 493/400; 493/401; 493/402; 493/416; 493/421; 493/436; 493/440; 493/460; 493/461

(58) Field of Search ..... 493/398, 400, 493/401, 402, 403, 405, 416, 421, 436, 440, 460, 461, 16, 917

(56) References Cited

U.S. PATENT DOCUMENTS 3,206,191 A * 9/1965 Hantscho ..... 271/303
3,999,454 A * 12/1976 Tiso et al. ..... 270/21.1
4,269,402 A * 5/1981 Fischer et al. ..... 101/227
4,746,107 A * 5/1988 Schneider et al. ..... 270/21.1
4,754,959 A * 7/1988 Kobler et al. ..... 270/21.1
4,988,330 A * 1/1991 Bensberg ..... 493/11
5,273,515 A 12/1993 Fenske ..... 493/416
5,425,697 A 6/1995 Lanvin ..... 493/426
5,439,206 A * 8/1995 Raasch et al. ..... 270/21.1

FOREIGN PATENT DOCUMENTS

DE 43 32 792 3/1995

* cited by examiner

*Primary Examiner*—Rinaldi I. Rada
*Assistant Examiner*—Brian Nash
(74) *Attorney, Agent, or Firm*—Cohen, Pontani, Lieberman & Pavane

(57) ABSTRACT

Apparatus for splitting a stream of products coming from a folding group making any desired fold and feeding it to either of two further folding groups making a respective further fold includes a stripper assembly guiding the products away from a folding cylinder of the folding group making the desired fold, a diverter element, and tape guide systems that transport the products from the latter to the further folding groups. The stripper assembly includes a tape guide module that can be pivoted towards the folding cylinder, and at least one stripper tongue; the tape guide systems and the diverter element being integrated into a splitter module.

19 Claims, 7 Drawing Sheets

SPLITTER MODULE FOR FOLDING SYSTEM ON PRINTING MACHINES

BACKGROUND OF THE INVENTION

1. Field of the Invention

The invention relates to an apparatus for splitting a product stream coming from a folding group making a desired fold and feeding it to either of two further folding groups for making a further fold, wherein the products are stripped from a folding cylinder and diverted into one of two tape guide systems for transport to the further folding groups.

2. Description of the Related Art

The article "Die Neuheit—variabler Falzapparat den Offsetdruck" [What's new—a variable folder for offset printing], which appeared in the technical journal Deutscher Drucker No. 43/18/11/1999, page w 12 ff, discloses a splitter station with a single drive, which splits or separates a product stream into two part product streams and forwards it to two folders making a third fold.

SUMMARY OF THE INVENTION

The object of the invention is to provide an apparatus for splitting a product stream for folding systems which, in the event of a production change, can be easily adapted to the production conditions.

According to the invention, the products are stripped away from the folding cylinder by a tape guide module that can be pivoted toward the folding cylinder, and guided away from the folding cylinder by at least one stripper tongue which cooperates with the tape guide module. The tape guide systems and a diverter element are integrated into a splitter module.

The apparatus is equipped with a single drive, which drives both all the tape guide systems for feeding the product into the two folders which process the product further, in particular third folds, and also the tape guide module and the diverter element.

A significant advantage of the invention is that the splitter apparatus is equipped with a tape guide module which, in particular, can be pivoted away from the folding cylinder of the second fold. This action of pivoting away from the folding cylinder permits, firstly, referencing of the single drive motor of the splitter module to the folding group which, in particular, makes the second fold, which makes position equalization possible and is brought about in a referencing position, as it is called, of this tape guide module, and, secondly, pivoting the tape guide module into a service position for product removal, for example in the event of a paper jam or to carry out maintenance work.

During the referencing operation of the single drive of the splitter module, the latter is positioned in a defined rotational angle position (phase angle) in relation to the virtual guide shaft and therefore in a definable rotational angle position in relation to the second fold. In the process, the second fold comes to a standstill.

For this purpose, it is necessary for the tape guide module that can be pivoted away to be located in a referencing position which deviates, in particular approximately parallel, from the virtual delivery plane on which the products from the second fold are conveyed out of the folding cylinder by the tape guide module. This is done as soon as the second fold is at a standstill ($n_{2\ fold}=0$), that is to say without lifting the tape guide module above the folding cylinder, this module would slide either on the folding cylinder and/or on the product located there during the referencing operation ($n_{SM}>0$). Consequently, the avoidance of paper jams may be mentioned as a further advantage of this pivoting away into the referencing position.

Alternative drive designs for avoiding referencing between a splitter module and second fold are technically significantly more complicated. For example, it would be an alternative to implement the drive from the second fold outward and to equip the latter with an increase in power, which would be about 20 kW.

However, this would lead to a higher concentration of power in the second fold, with all the disadvantages for the overall modular concept.

A drawback of this type for the overall modular concept can be seen for example, in the necessary increased design and dimensioning of all the drive elements which transmit forces and torque, such as gear mechanisms, gear wheels, pairs of gear wheels, etc. The above-described increase in power of the drive of the second fold is transmitted to all the drive elements with a drive connection to the latter, and makes this increased dimensioning of these drive elements absolutely necessary.

A further alternative drive variant would be to derive the drive of the splitter apparatus from the drives of the folding groups making the third fold, but this would have the drawback of a more complicated drive guidance, the drawback of necessary increases in power and therefore, at the same time, also the drawback of a detrimental effect on the overall modular concept.

As already explained above, the power of the drives of the folding groups making the third fold is transmitted to all the drive elements having a drive connection thereto. Because of the increase in power, however, increased dimensioning of the driving elements having a drive connection to the drive of the folding groups making the third fold is absolutely necessary.

A further disadvantage is influencing the tape speed as a result of the folding-blade adjustment. This is because the tape speed is implement by means of the single drive of the folding group making the upper third fold or the folding group making the lower third fold.

It is beneficial that reject diverters are arranged in the apparatus in such a way that specific idling of the folder in the region between the second and third folds is possible. Reject diverters are arranged upstream of the assemblies, for example the folding tables, of both folding groups making the third fold, in order to protect these folding groups. An additional reject diverter is arranged upstream of the diverter elements in order to be able to dispose of "older products" following a production change, for example in the event of a change from collecting to non-collecting.

A further advantage of the invention is that the drive rolls are configured and arranged in such a way that, in particular as a result of their size and their arrangement between the runs, for example between the upper and the lower run, of the belt elements, both in the forward and product-carrying run, and in the returning and non-product-carrying run, which results in a more uniform tape tension distribution. The more uniform tape tension distribution is advantageous in that a quieter tape run is effected.

An alternative variant to this would be to operate with more than two drive points in the same tape paths, in order to achieve the advantage of the more uniform tape tension distribution.

A further particular advantage is changing over the diverter element between the product types non-collecting (that is to say double-split), collecting or loading an individual folding group, the changeover being carried out by lifting the cam roller by means of which the diverter element is controlled to suit production, and by displacing the cam discs.

It is advantageous that this relatively simple arrangement, comprising cam roller and associated cam discs, for example as compared with a step gearbox which alternatively could be used, can be implemented more easily and more cost-effectively, since a step gearbox would have to make two rotational speeds and two fixed positions possible.

An alternative drive variant and control variant of the diverter element results if, instead of the cam drive described above and comprising cam roller and cam discs, the single drive of the diverter element is provided by a cam disc and a motor, in particular a single drive motor, which, in the operating mode "operate at speed 0 (rotational speed zero)", following prior positioning of the diverter elements and also by changing the rotational speed, the four operating modes mentioned above, which result from the two rotational speeds and two fixed positions, could be implemented.

In the operating mode "operate at speed 0", a holding moment is transmitted to the diverter element by the motor, so that the diverter element is not rotated on account of the products striking it during production.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
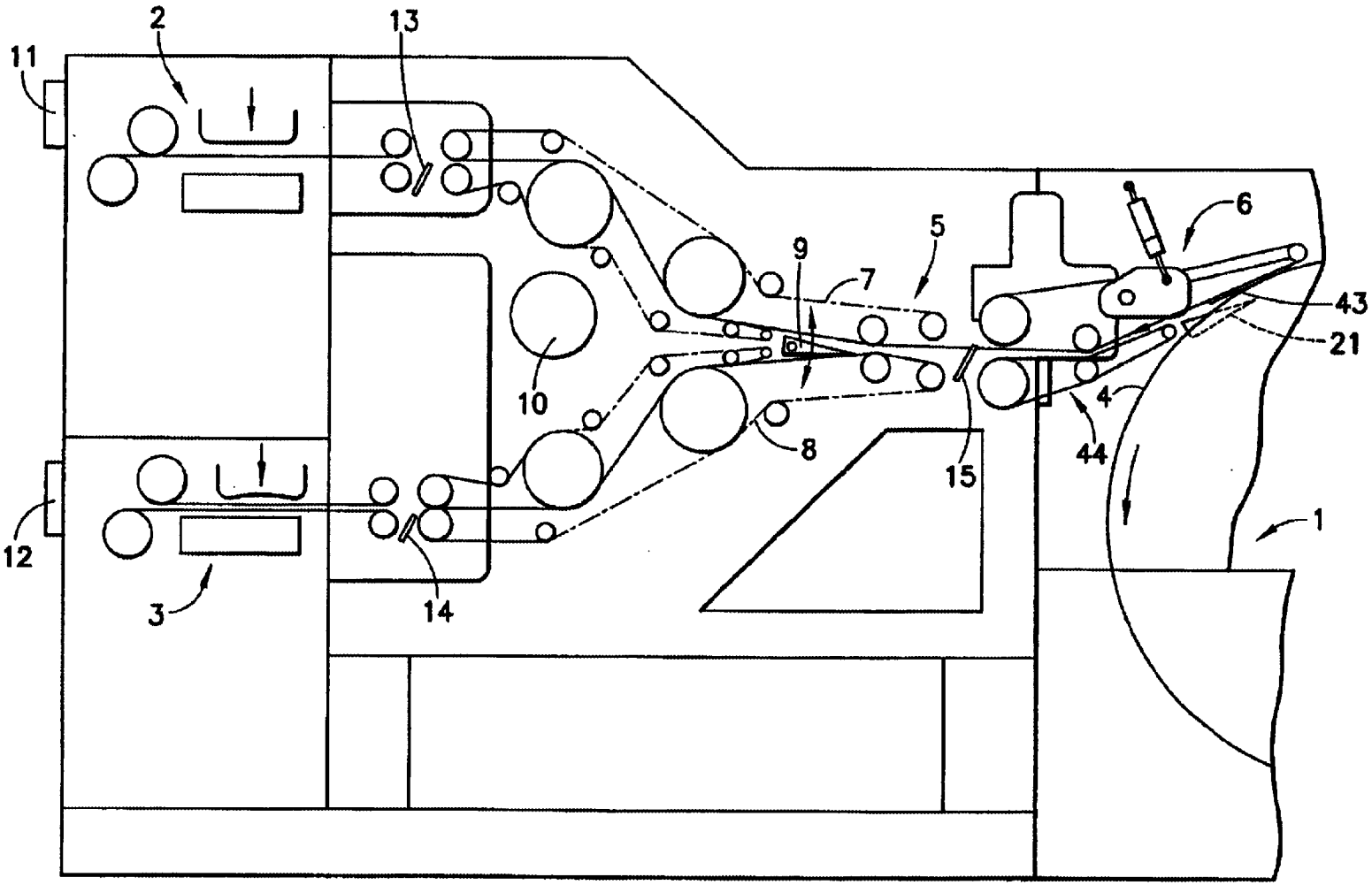
FIG. 1 shows a folder having a splitter module and a tape guide module.

FIG. 1 shows a folder 1, which comprises an upper folding group 2 making a third fold, referred to below as DFO, and a lower folding group 3 making a third fold, referred to below as DFU. A folding cylinder 4 of a folding group making a second fold is integrated into the folder 1. In addition, in between the folding groups 2; 3 and the folding cylinder 4, designed for example as a folding-draw cylinder, there are also arranged in the folder 1 a splitter module 5, a tape guide module 6 and tape guide module 44. The tape guide module 6 can be pivoted towards the folding cylinder 4.

At the folding cylinder 4, in particular at the circumference in the vicinity underneath the tape guide module 6, there are arranged one or more stripper tongue 21 which, not specifically illustrated, are mounted on frame walls of the folder 1. The splitter module 5 comprises tape guide systems 7; 8 and a diverter element 9. The splitter module 5 and the tape guide module 6 are driven by a single drive 10. The tape guide system 7 conveys products 43 to the DFO 2, and the tape guide system 8 conveys the products 43 to the DFU 3.

The folding groups 2;3 are in each case driven by a single drive 11; 12.

Arranged between the splitter module 5 and the folding groups 2; 3 are reject diverters 13; 14. In addition, a reject diverter 15 is arranged between the tape guide module 6 and the splitter module 8, in particular in an area upstream of the diverter element 9. By means of the reject diverters 13; 14; 15, it is made possible specifically to run the folder 1 empty in the area between the second and third fold. The rejects diverters 13; 14 are arranged upstream of assemblies, for example folding tables, belonging to the two folding groups 2; 3 making the third fold, in order to protect these folding groups 2; 3. The additional reject diverter 15 in the area upstream of the diverter element 9 is used to make it possible to dispose of, for example, "older products" following a production change, for example in the event of a change from collecting to non-collecting.

Figure 2:
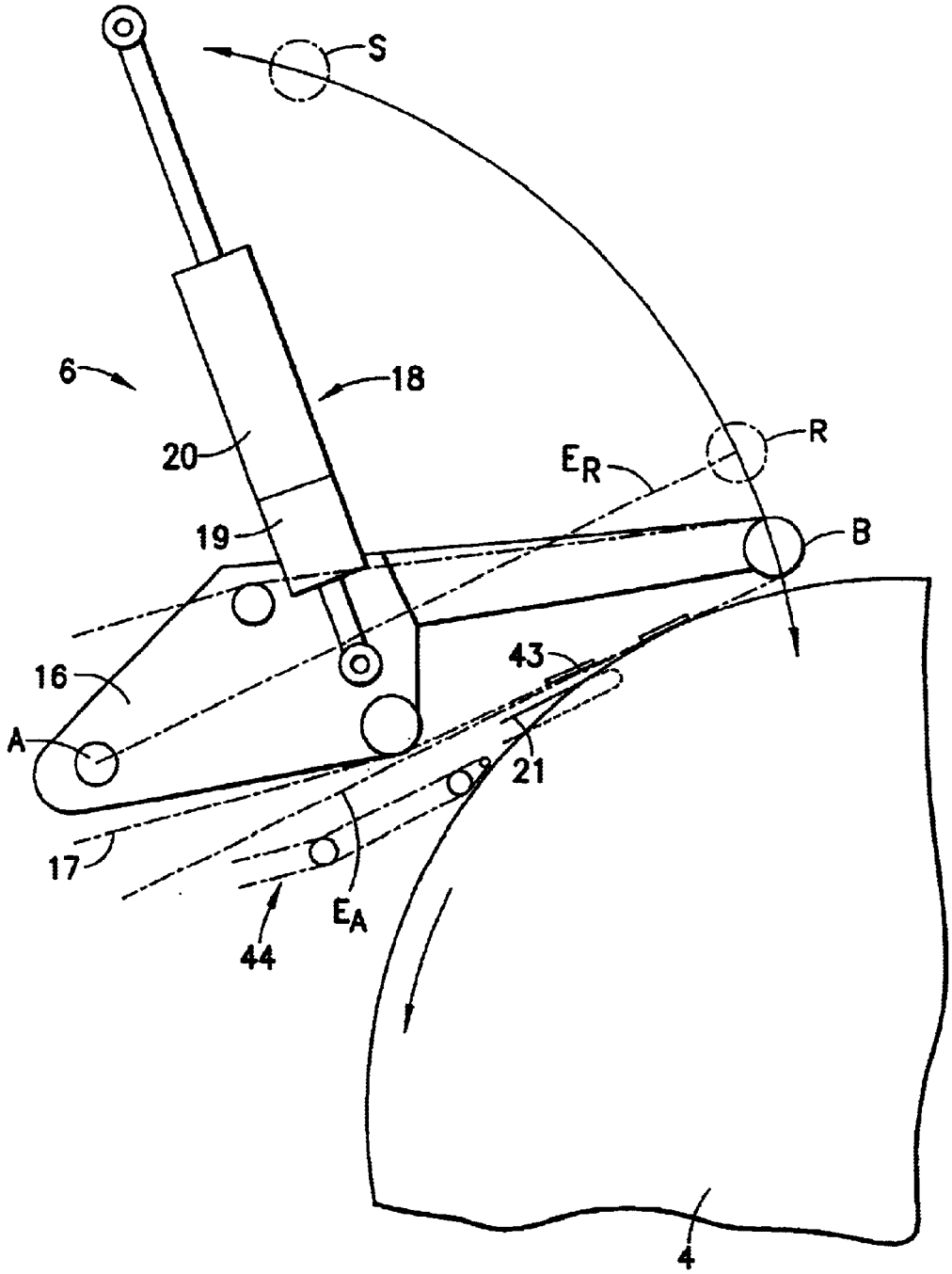
FIG. 2 shows a pivotable tape guide module.

FIG. 2 reproduces the construction of the tape guide module 6. The tape guide module 6 comprises a basis body 16 with a tape system 17 arranged on it. The tape system 17 comprises at least one circulating belt element. The basic body 16 is, for example, mounted either in a frame wall (not specifically illustrated) of the folder 1 or in a frame wall (not specifically illustrated) associated with the splitter module 5. Mounted on the basic body 16 is a pressure-medium-operated operating cylinder 18, for example a pneumatic cylinder 18. The pressure-medium-operated operating cylinder 18 is mounted at its other end on a frame wall (not specifically illustrated) of the folder 1. The pressure-medium-operated operating cylinder 18 preferably comprises two operating cylinders 19; 20. The tape guide module 6 can be pivoted about a pivot A towards the folding cylinder 4, into an operating position B, a referencing position R and a service position S. According to the invention, the action of pivoting from the operating position B into the referencing position R is carried out by means of the first operating cylinder 19. The referencing position R of the tape guide module 6 is arranged in a referencing plane $E_R$, which is approximately parallel to a delivery plane $E_A$ conveying the products 43 from the folding cylinder 4. The tape guide module 6, when in the referencing position R, is set slightly away from the folding cylinder 4, so that it does not drag on the folding cylinder 4.

The tape guide module 6 is pivoted into the service position S by means of the second operating cylinder 20. In the operating position B, the products 43 are conveyed out of the folding cylinder 4 by means of the circulating tape system 17 arranged on the tape guide module 6 and the stripper tongue 21, and are fed to the folding groups 2; 3 via the splitter module 5, in particular via the diverter element 9 and the tape guide systems 7; 8.

For exact feeding of the products 43 from the folding cylinder 4 to the two folding groups 2; 3 that process the product 43 further, the entire apparatus, the tape guide module 6, the splitter module 5 with the tape guide systems 7; 8 and, in particular, the diverter element 9 steering the products 43, must be coordinated with the respective product 43. This product change includes alignment procedures, changeover operations and a referencing operation during start-up.

The alignment operations are carried out manually, by means of eccentric shafts and setting spindles, at defined locations (not specifically illustrated) in the tape guide system.

Figure 4:
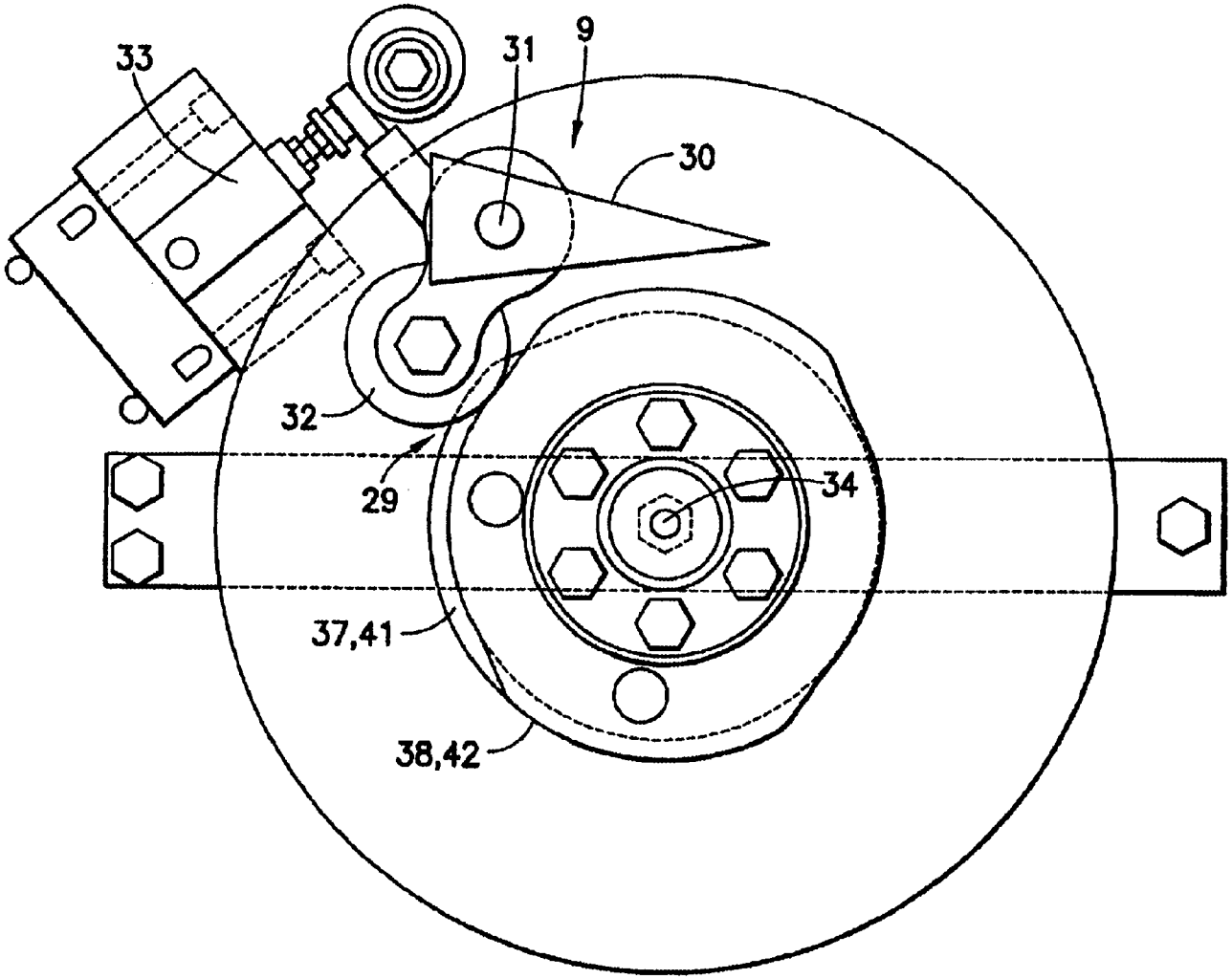
FIG. 4 shows a diverter element with drive and control device.
Figure 5:
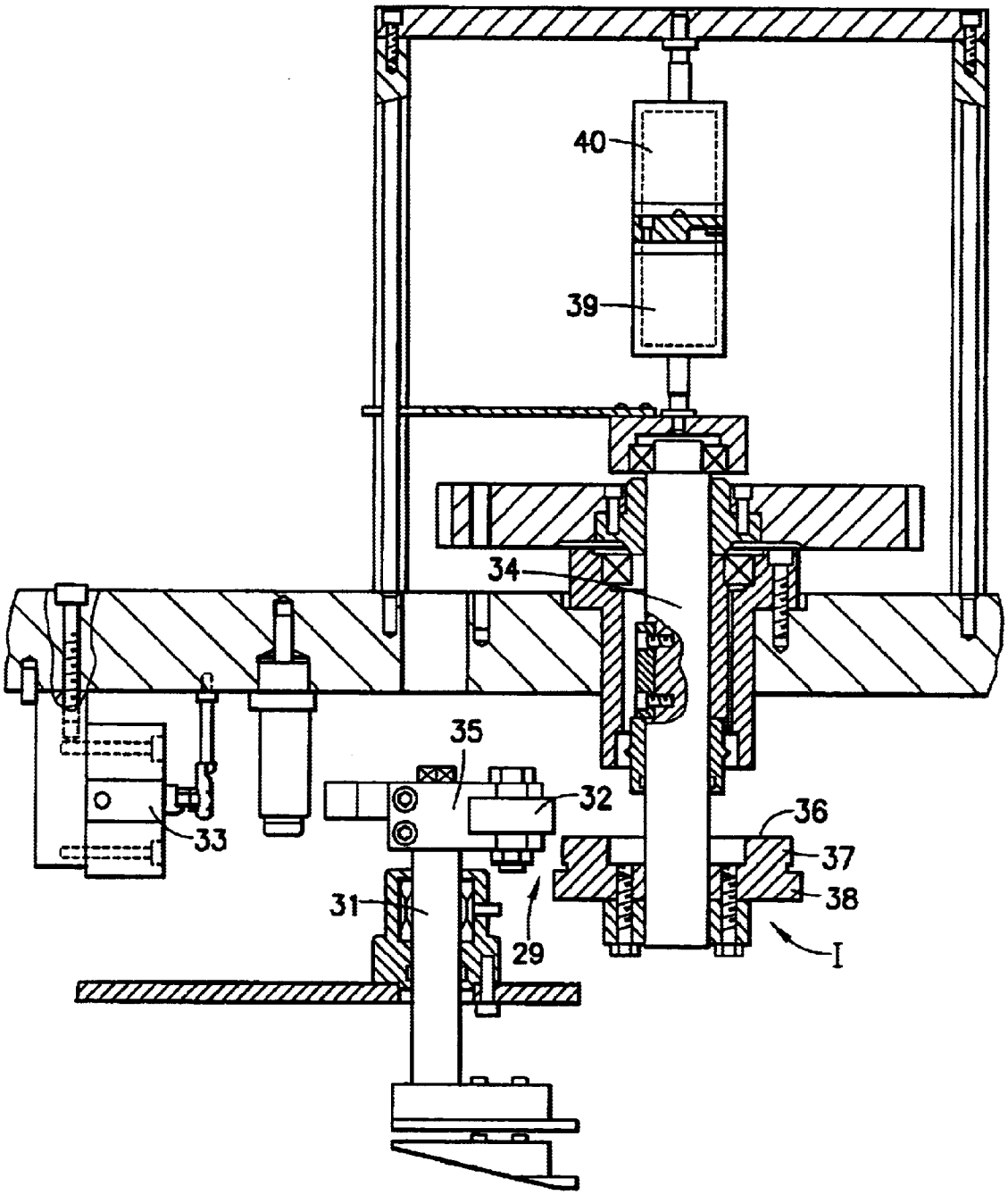
FIG. 5 shows a view as a plan view of the diverter element according to FIG. 4.

The changeover operations of the diverter element 9 consist in lifting a control roller 32 and, if necessary, lowering the control roller 32, and are initiated by means of the product selection at the control desk (FIG. 4 and FIG. 5).

Referencing operations in general are required when single drives 10; 11; 12 have been removed from the coupling assembly and the coupling assembly is reformed, for example in the event of production changes.

Production changes are carried out at a standstill. At a standstill, the tape guide module 6 is in the referencing position R; if the tape guide module 6 should be in the service position S, start-up (referencing) is not possible, and it must first be switched into the referencing position R from the operating panel or control desk on the unit. The second fold is initially at rest. The single drive motor 10 of the splitter module 5 begins to rotate, when the latter has reached a defined rotational angle position in relation to the virtual guide shaft, the second fold, in particular the folding cylinder 4, also begins to rotate, and at the same time the tape guide module 6 pivots into the operating position B. Finally, all the drives, the single drives 10; 11; 12 and the folding cylinder 4 run simultaneously up to speed together with the machine.

Figure 3:
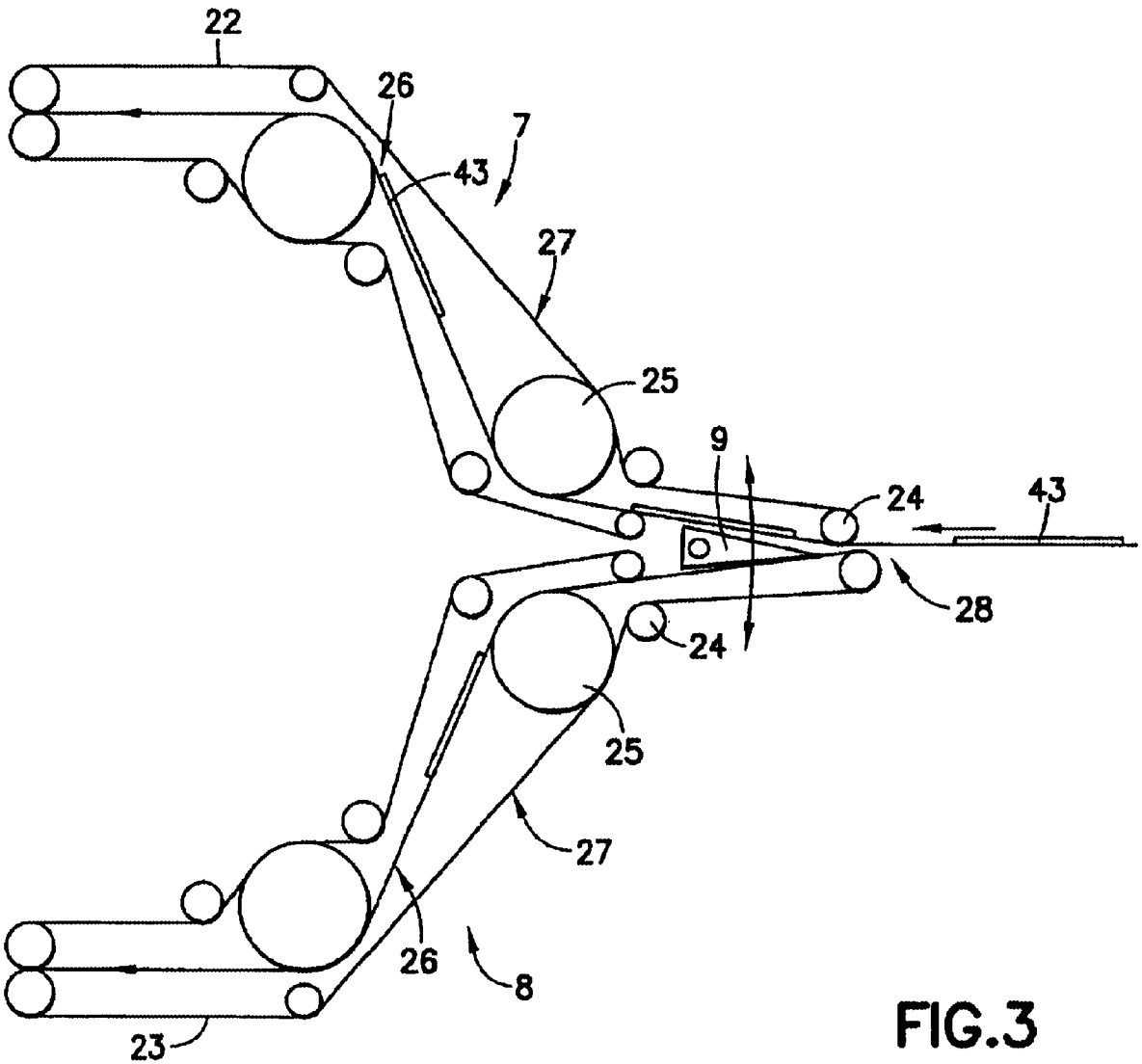
FIG. 3 shows tape guide systems of the splitter module according to FIG. 1.

FIG. 3 shows the construction of the tape guide systems 7; 8 of the splitter module 5. The tape guide systems 7; 8 comprise belt elements 22; 23, which are penetrated by guide rolls 24 and drive rolls 25 in such a way, that these drive rolls 25 are configured in such a way, that, as a result of their size and their arrangement between runs 26; 27 of the belt elements 22; 23, they drive both in the forward and product-carrying run 26 and in the return and non-product-carrying run 27, which achieves a more uniform tape tension distribution and therefore a quieter tape run. In this case, the drive rolls 25 are all driven at the same rotational speed, in order to ensure the same conveying speed at all points on the tape.

The diverter element 9 of the splitter module 5 is arranged in an inlet area 28 of the tape guide systems 7; 8.

FIG. 4 and FIG. 5 show a diverter element 9 of the splitter module 5 with the drive and/or control device 29. The diverter element 9 comprises a guide element 30 which, for example, is wedge-like and is mounted on a shaft 31 such that it can move. The guide element 30 is connected to the control roller 32 and an operating cylinder 33 via a lever 35. The operating cylinder 33 and the shaft 31 are mounted (not specifically illustrated) on side walls of the folder 1.

Mounted on a shaft 34 arranged parallel to the guide element 30 are cam tracks 37; 38, designed as cam discs. The cam tracks 37; 38 are, for example, arranged on a cam block 36, which is mounted on the shaft 34. The shaft 34 is connected to a drive device, which is not specifically illustrated but which moves the shaft 34 in rotation, and to two pressure-medium-operated operating cylinders 39; 40 for displacing the shaft axially. The operating cylinders 39; 40 and the shaft 34 are mounted (not specifically illustrated) on frame walls of the folder 1.

The two cam tracks 37; 38 are provided with different profiles. The cam track 37 as a profile 41 having two detents. The cam track 38 has a profile 42 with four detents.

The cam track 38 is used for the production mode non-collecting, split, the cam track 37 is used for the production mode collecting, split.

A control roller 32 rests on one of the cam tracks 37; 38 and rolls on the latter during rotation of these cam tracks 37; 38. As a result of the control roller 32 rolling on the cam tracks 37; 38, depending on the profile of this cam track 37; 38, the position of the diverter element 9 is controlled.

Given the same drive rotational speed, the number of strokes per unit time is doubled when the cam disc 38 is used, which is used for the production mode non-collecting, split, as compared with the cam disk 37, which is used for the production mode collecting, split.

The control device 29 already mentioned above is therefore a cam drive, which comprises the lever 35 with control roller 32 and the cam tracks 37; 38.

To change the diverter element 9 to a different production mode, first of all the control roller 32 is lifted off one of the cam tracks 37; 38 by retracting the operating cylinder 33.

Figure 6:
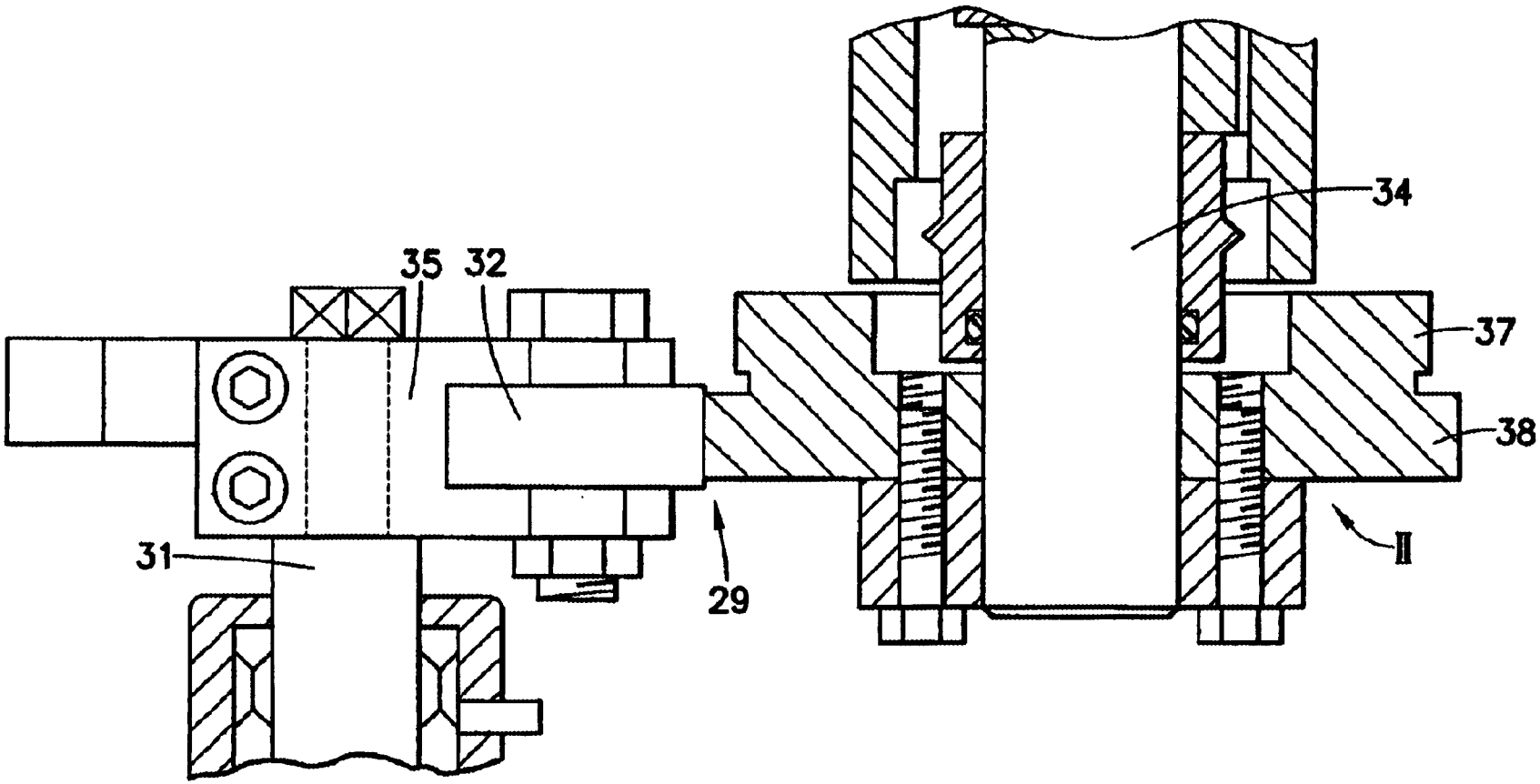
FIG. 6 shows a position of the cam drive according to FIG. 5.
Figure 7:
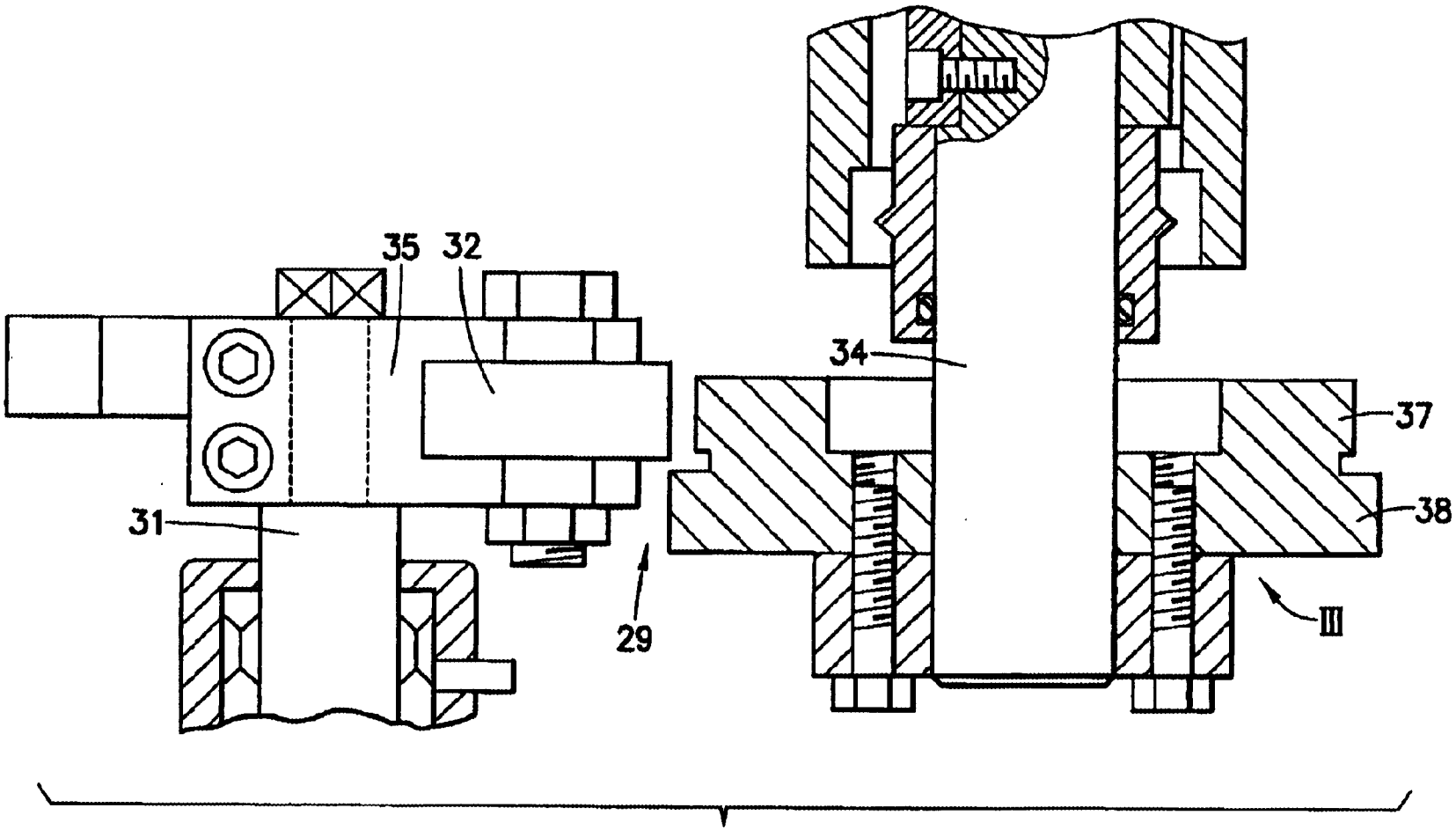
FIG. 7 shows a further position of the cam drive according to FIG. 5.

The cam track 37; 38 required for the desired production mode is brought into position I, II or III in relation to the cam roller 32 by means of displacing the shaft 34 bearing the cam block 36 via the operating cylinders 39; 40 (see FIG. 5, FIG. 6 and FIG. 7).

In position II or III, the control roller 32 is finally replaced on the appropriate cam track 37; 38 by extending the operating cylinder 33.

In position I, there is no cam track under the control roller 32. The operating cylinder 33 remains retracted or extended, depending on which apparatus, DFO 2 or DFU 3, is intended to be used in production.

Alternatively, instead of the use of the operating cylinders 33; 39; 40, drive devices which are not specifically illustrated, for example motors, can be used.

The entire apparatus for splitting a product stream is not intended to be restricted to the use between a folding group making a second fold and two folding groups 2; 3 making a third fold, although this is the preferred area of use of the aforementioned apparatus. The apparatus can also be arranged downstream of a folding group which makes any desired fold, in order to divide up a product stream and feed it to a plurality of further-processing folding groups.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. Apparatus for splitting a stream of products coming from a folding group for making a desired fold, said folding group comprising a folding cylinder, and for feeding it to either of two further folding groups for making a further fold, said further folding groups being drivable separately from said folding group for making said desired fold, said apparatus comprising a tape guide module that can be pivoted about a pivot toward the folding cylinder for guiding the products away from the folding cylinder, at least one stripper tongue which cooperates with said tape guide module to guide said products away from said folding cylinder in a delivery plane, a splitter module comprising a pivotably mounted diverter element for diverting said products from said tape guide module toward either of said two further folding groups, and a pair of tape guide systems for transporting said products from said diverter element to said either of said two further folding groups, and a single drive for both said tape guide module and said splitter module.

2. An apparatus as in claim 1 wherein said tape guide module can be pivoted away from the folding cylinder into a referencing position which permits positioning the single drive in a defined angular position with respect to the folding cylinder.

3. An apparatus as in claim 2 wherein said referencing position and said pivot are in a referencing plane which is parallel to said delivery plane.

4. An apparatus as in claim 2 wherein the tape guide module can be pivoted into a service position which is further away from the folding cylinder than the reference position.

5. An apparatus as in claim 1 wherein each of said tape guide systems comprises a pair of belt elements, each said belt element having a forward run and a return run, and a drive roll arranged between runs of at least one of said belt elements, whereby the forward run and the return run of each said at least one belt element can be driven.

6. An apparatus as in claim 1 further comprising a cam drive for controlling said diverter element, said cam drive comprising a control roller arranged on the diverter element, and a pair of motor driven cam tracks which ride against said cam roller.

7. An apparatus as in claim 6 further comprising a drive for lifting said control roller off of said cam tracks.

8. An apparatus as in claim 7 wherein said drive is one of a pressure-medium-operated cylinder and a motor.

9. An apparatus as in claim 6 wherein said cam tracks are arranged on a shaft that can be rotated by a motor.

10. An apparatus as in claim 9 wherein said shaft can be displaced axially to position said cam tracks with respect to said control roller.

11. An apparatus as in claim 10 comprising at least one drive for axially displacing said shaft.

12. An apparatus as in claim 11 wherein said at least one drive comprises a pair of pressure-medium-operated operating cylinders.

13. An apparatus as in claim 6 wherein said cam tracks are arranged on a cam block.

14. An apparatus as in claim 1 further comprising reject diverters assigned to respective ones of said tape guide module and said further folding groups.

15. An apparatus as in claim 14 wherein one of said reject diverters is arranged between said tape guide module and said diverter element, and two of said diverters are arranged upstream of respective said further folding groups.

16. Apparatus as in claim 1 wherein said desired fold is a second fold, and said further fold is a third fold.

17. Apparatus for folding products, said apparatus comprising a folding group for making a desired fold, said folding group comprising a folding cylinder, two further folding groups for making a further fold, said further folding groups being drivable separately from said folding group for making said desired fold, a tape guide module that can be pivoted about a pivot toward the folding cylinder for guiding the products away from the folding cylinder, at least one stripper tongue which cooperates with said tape guide module to guide said products away from said folding cylinder in a delivery plane, a splitter module comprising a pivotably mounted diverter element for diverting said products from said tape guide module toward either of said two further folding groups, and a pair of tape guide systems for transporting said products from said diverter element to said either of said two further folding groups, and a single drive for both said tape guide module and said splitter module.

18. An apparatus as in claim 17 wherein said folding cylinder is a folding draw cylinder.

19. An apparatus as in claim 17 wherein said tape guide module can be pivoted away from the folding cylinder into a referencing position which permits positioning the single drive in a defined angular position with respect to the folding cylinder.

* * * * *